United States Patent [19]

Cavell

[11] 4,075,821

[45] Feb. 28, 1978

[54] APPARATUS FOR CLOSING AN ARTICLE WRAPPER

[75] Inventor: Raymond J. Cavell, Grand Blanc, Mich.

[73] Assignee: General Motors Corporation, Detroit, Mich.

[21] Appl. No.: 771,434

[22] Filed: Feb. 24, 1977

[51] Int. Cl.[2] ..... B65B 7/20; B65C 11/04

[52] U.S. Cl. ..... 53/376; 156/443; 156/578

[58] Field of Search ..... 53/376, 377; 156/443, 156/578

[56] References Cited

U.S. PATENT DOCUMENTS 2,685,768 8/1954 Mobley ..... 53/376 X 3,872,652 3/1975 Labantschnig et al. ..... 53/376

*Primary Examiner*—Travis S. McGehee

*Attorney, Agent, or Firm*—Edward J. Biskup

[57] ABSTRACT

Apparatus for closing an article wrapper that has a lower tubular portion integrally formed with an upper flap. The apparatus includes a horizontally extending frame having an entrance section and a conveyor section with the former having a rail for maintaining the flap spaced from the tubular portion as the wrapper moves toward the conveyor section. The conveyor section has a power-operated flap depressor that serves to move the lower edge of the flap into position for bonding engagement with the tubular portion while the wrapper is being moved by an endless belt towards the exit end of the apparatus.

3 Claims, 6 Drawing Figures

APPARATUS FOR CLOSING AN ARTICLE WRAPPER

It has become quite common to package sheet metal articles such as automobile fenders in a one-piece type wrapper made of corrugated paperboard that is designed to completely enclose the article to prevent the latter from being damaged during shipment. One form of wrapper that has been used for this purpose can be seen in U.S. Pat. No. 3,780,933, issued on Dec. 25, 1973 in the name of Wayne E. Freeman, and assigned to the assignee of this invention. As can be seen in the latter mentioned patent, the wrapper includes a tubular portion provided with a pair of openings for accommodating the projecting parts of the fender on the opposite sides of the wheel well. The flap is integrally formed with the tubular portion and is adapted to extend over the convex outer surface of the fender and the completed package is held together by a pair of straps.

This invention concerns an apparatus for closing an article wrapper that is similar to the above-described wrapper, but rather than utilizing straps for securing the package, the apparatus automatically applies an adhesive to the tubular portion so that the flap can be subsequently bonded thereto. More specifically, the apparatus according to the invention includes an elongated horizontally extending base frame divided into an entrance section and a conveyor section. The entrance section includes a plurality of rollers for supporting the wrapper in a generally upright position during horizontal movement thereof towards the conveyor section while, at the same time, maintaining the flap spaced from the tubular portion. The conveyor section is horizontally aligned with the entrance section and includes a power-driven endless belt that serves to automatically move the wrapper along the conveyor section. An adhesive dispenser is carried by the conveyor section for applying a glue to and along the length of the outer side wall of the tubular portion as the wrapper moves into the conveyor section. A positioner member, in the form of a trough, is located adjacent the conveyor section for receiving the flap and serves to guide the latter into contact with the tubular portion after the glue has been applied thereto. The positioner member is provided with a flat floor and a depressor member is formed with the conveyor section for engaging an upper portion of the flap and applying downward pressure thereto for maintaining the lower straight edge of the flap in contact with the flat floor prior to the flap contacting the tubular portion. In addition, the conveyor section is provided with an elongated compressor unit for maintaining the flap in firm contact with the tubular portion to assure that the glue is cured so as to cause the flap to be bonded to the tubular portion and thereby provide a secured package for the article.

The objects of the present invention are to provide a new and improved apparatus for automatically closing and securing an article wrapper as the latter moves from the entrance to the exit end of the apparatus; to provide a new and improved apparatus for automatically closing and applying a glue for bonding the flap of a corrugated article wrapper to a tubular portion of the wrapper; to provide a new and improved apparatus having an elongated frame provided with a plurality of rollers which serve to maintain an article wrapper in a substantially vertical position while the wrapper is being moved horizontally from an entrance section to a conveyor section wherein the flap of the wrapper is automatically bonded to the body of the wrapper so as to provide a completely secured package for shipment; to provide a new and improved apparatus for closing a fender wrapper and that serves to position the flap properly relative to the lower tubular portion of the wrapper after which a glue is applied to the tubular portion for automatically joining the flap thereto; and to provide a new and improved apparatus for closing and bonding the flap of a fender wrapper to the tubular portion thereof which includes means for spacing the lower edge of the flap from the tubular portion prior to applying adhesive to the latter and also includes means for applying a downward pressure on an upper part of the flap so as to properly position the lower edge of the flap for subsequent bonding engagement with the tubular portion.

Other objects and advantages of the present invention will be apparent from the following detailed description when taken with the drawings in which.

Figure 1:
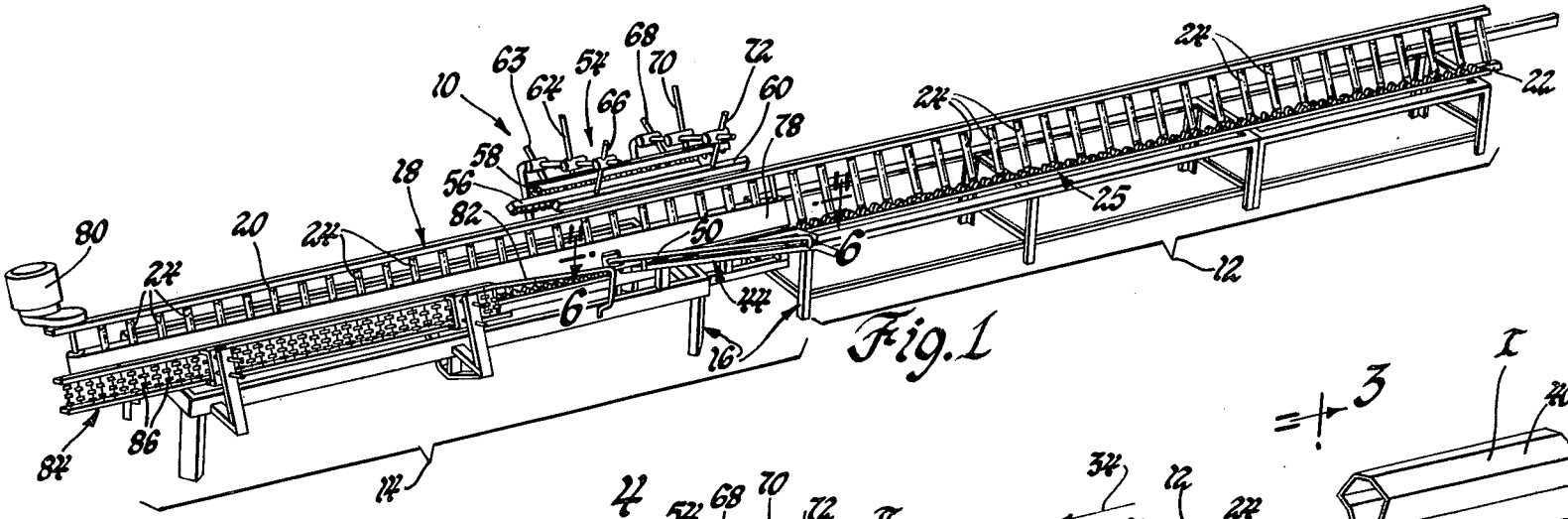
FIG. 1 is a perspective view showing the apparatus made in accordance with the invention.
Figure 3:
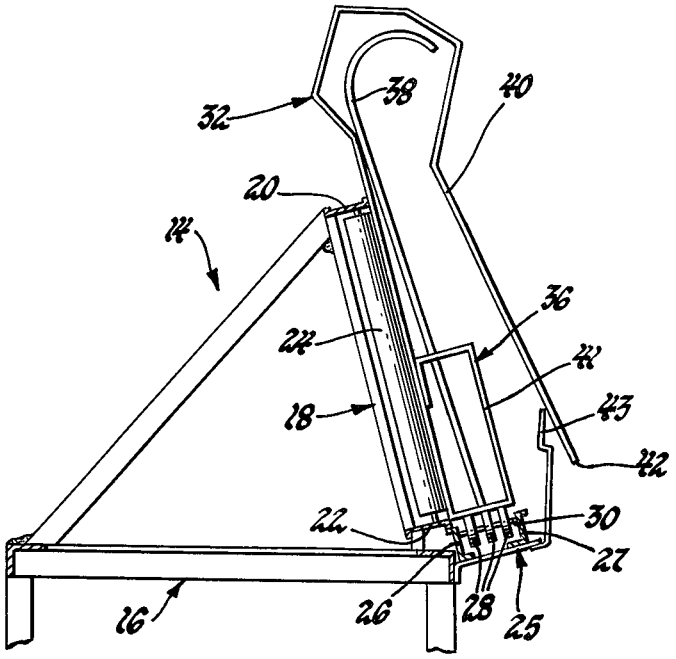
FIG. 3 is an enlarged sectional view taken on line 3—3 of FIG. 2 and shows a fender wrapper located at the entrance section of the apparatus.
Figure 4:
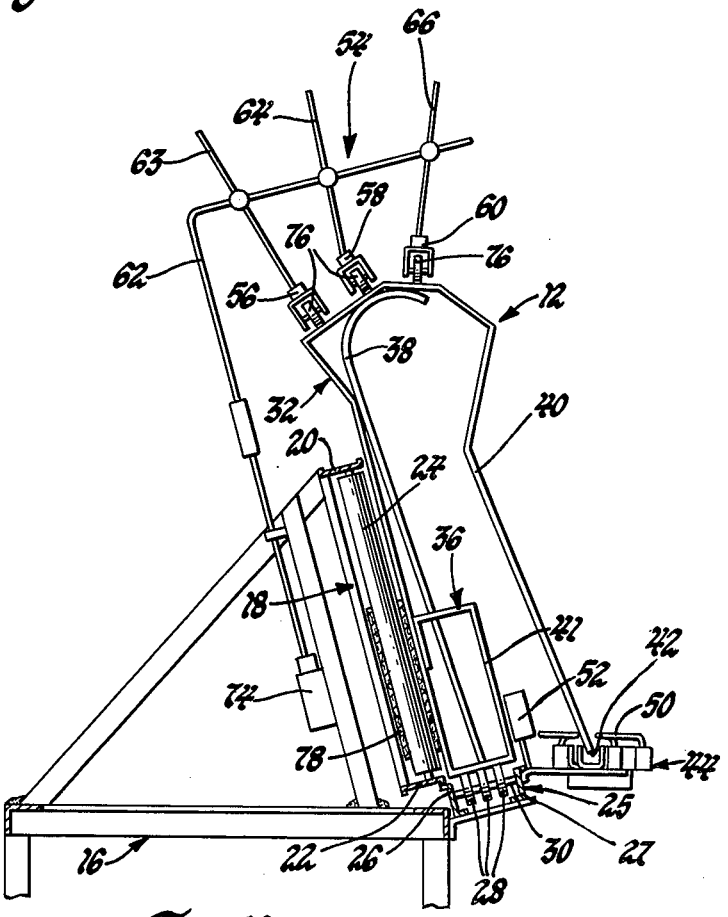
FIG. 4 is an enlarged sectional view taken on line 4—4 of FIG. 2 and shows the depressor member engaging the flap of the fender wrapper as the latter enters the conveyor section of the apparatus.
Figure 5:
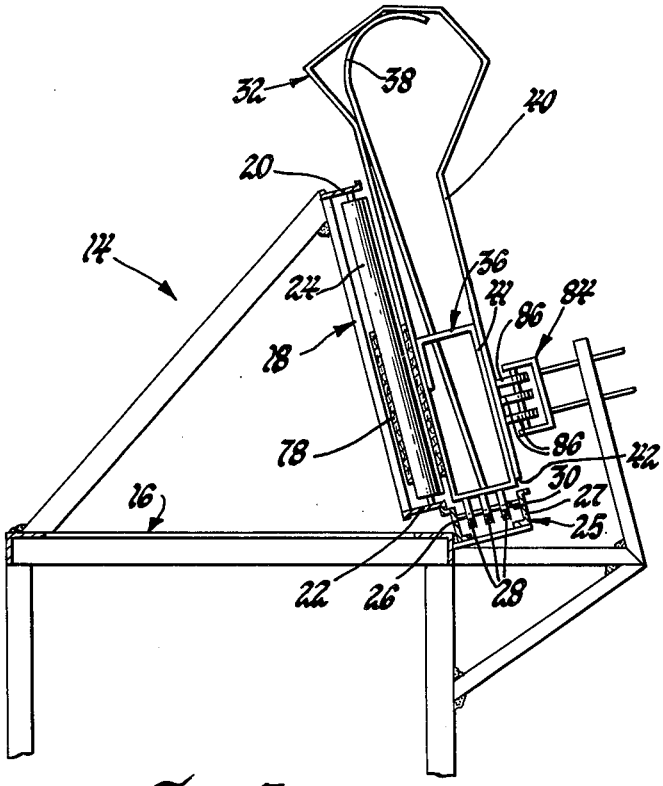
FIG. 5 is an enlarged sectional view taken on line 5—5 of FIG. 2 showing a fender wrapper at the exit end of the conveyor section.

Referring to the drawings and more particularly FIG. 1 thereof, the apparatus 10 according to the invention is divided into an entrance section 12 and a conveyor section 14 and is supported on a floor by an elongated base frame 16 having a plurality of vertical legs. The base frame 16 supports a roller frame 18 which comprises a pair of elongated parallel rails 20 and 22 which support a plurality of identical and uniformly spaced rollers 24 for rotation in spaced vertical planes which extend transversely to the longitudinal axis of the apparatus. The roller frame 18 extends the full length of the apparatus and, as seen in FIGS. 3, 4 and 5, each of the rollers 24 are located in a rearwardly inclined plane extending along the longitudinal axis of the apparatus. Adjacent the lower portion of the roller frame 18 is a roller support 25 consisting of a pair of laterally spaced and parallel rails 26 and 27 which are coextensive with the roller frame 18 and include a plurality of identical rollers 28 which are rotatably mounted on uniformly spaced shafts 30 the ends of which are fixed to the rails 26 and 27. Thus, it should be apparent that the rollers 24 and 28 rotate about axes which are perpendicular to each other as seen in FIG. 3 and serve to support an article wrapper 32 in a generally upright position for horizontal movement in the direction of the arrow 34 seen in FIG. 2 from the right-hand end of the apparatus 10 to the left-hand end thereof. During such movement, and as will be more fully described hereinafter, the fender wrapper 32 is automatically closed and made into a unitary package which securely holds the fender in place during shipment.

As alluded to hereinbefore, the fender wrapper 32 used with the apparatus 10 is similar to the fender wrapper shown in U.S. Pat. No. 3,780,933 in that it includes a tubular portion 36 provided with a pair of openings for receiving the projections of a fender 38 and also a flap 40 which is integrally formed with the tubular portion and extends upwardly and wraps around the outer convex part of the fender 38 for completely enclosing the latter. The fender wrapper 32, however, differs from the fender wrapper shown in the patent in that the flap 40 consists of a single sheet of corrugated paperboard terminating with a straight lower edge 42. As also alluded to hereinbefore, the fender wrapper disclosed in the patent has the flap thereof secured in position through a pair of straps. On the other hand, the fender wrapper 32 is intended to have the flap 40 thereof bonded to the outer side wall 41 of the tubular portion 36 and in order to facilitate this operation, the apparatus 10 is provided.

Figure 2:
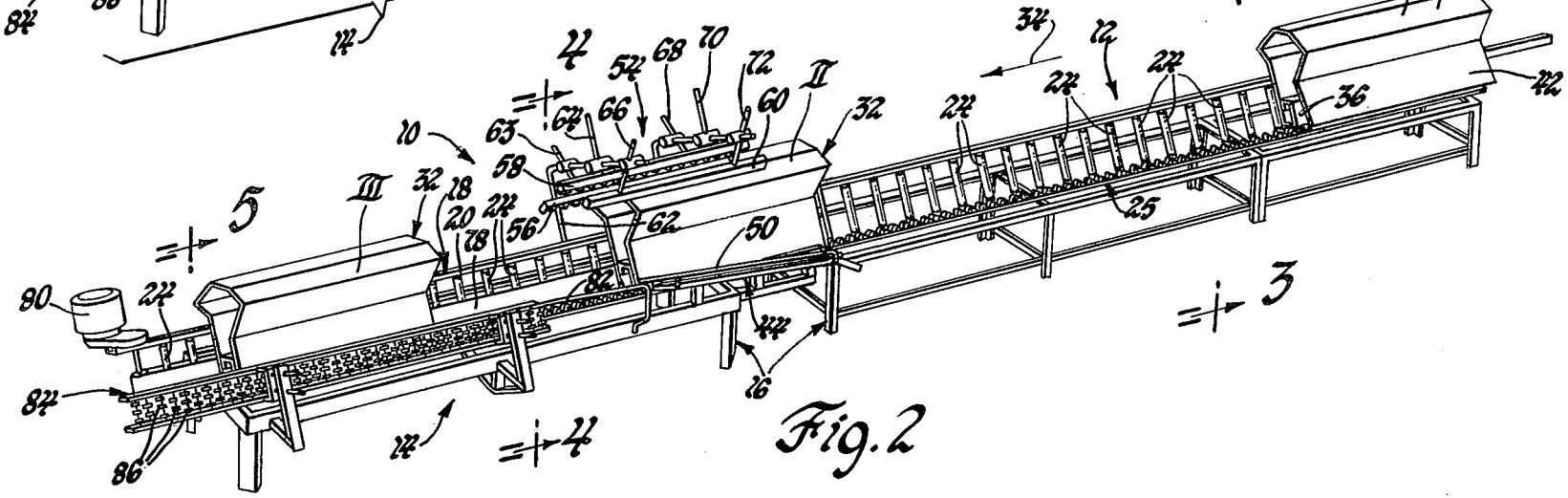
FIG. 2 is a view of the apparatus of FIG. 1 with article wrappers located in various positions along the length of the apparatus.

As seen in FIGS. 1 and 2, the fender wrapper 32 with the fender mounted therein is initially positioned at the entrance section 12 of the apparatus 10 and then manually moved in the direction of the arrow 34 towards the conveyor section 14. The rollers 24 and 28 facilitate movement of the fender wrapper 32 and due to the inclined arrangement of the rollers, the fender wrapper 32 is supported in a substantially upright position though slightly inclined rearwardly as seen in FIGS. 3 – 5 for better weight distribution. When the fender wrapper is located in the entrance section 12, as seen in FIG. 3, the flap 40 is spaced from the tubular portion 36 by an upstanding rail 43 fixed with the base frame 16 adjacent to the roller support 25. Although not shown in FIGS. 1 or 2, the rail 43 extends the full length of the entrance section 12 and is at a uniform height relative to the floor supporting the apparatus 10. As the fender wrapper 32 is moved from the position indicated by roman numeral I towards the conveyor section 14, the flap 40 maintains the position shown in FIG. 3. When the fender wrapper 32 enters the conveyor section 14, the flap 40 moves into a positioner member 44 shown in FIG. 6.

Figure 6:
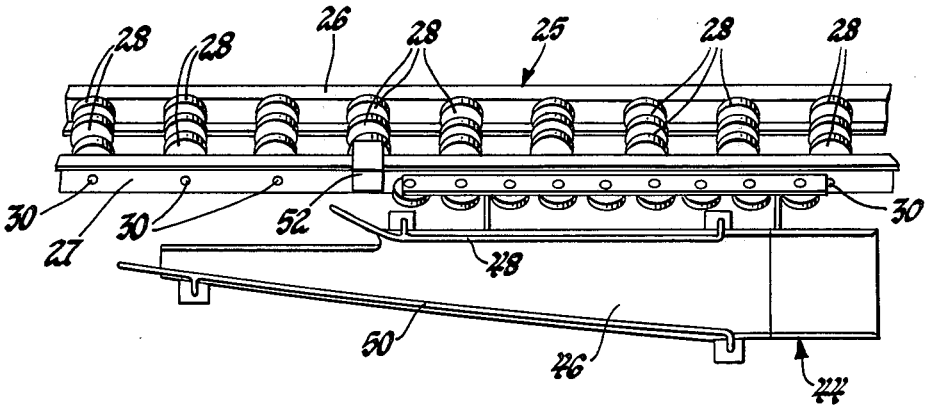
FIG. 6 is an enlarged plan view taken on line 6—6 of FIG. 1 showing in detail the construction of the positioner member incorporated with the apparatus.

As seen in FIG. 6, the positioner member 44 takes the form of a trough that has a flat floor 46 which tapers towards the left-hand end or exit end of the apparatus 10, and includes a pair of guide rails 48 and 50 the latter of which serves to gradually move the flap 40 towards the outer side wall 41 of the tubular portion 36 of the fender wrapper 32. Also, the positioner member 44 supports an adhesive dispenser 52 which serves to apply a hot-melt glue or the like to the outer side wall 41 of the tubular portion 36 as the latter moves along the rollers 24 and 28. In this regard, it will be noted, that although not shown, it will be understood that a suitable electric circuit having strategically placed micro-switches will control the operation of the dispenser 52. In other words, when the tubular portion 36 of the fender wrapper 32 is located in the position indicated by roman numeral II in FIG. 2, a mirco-switch will be tripped to cause the dispenser 52 to apply the glue directly to the side wall 41. After the tubular portion passes the dispenser 52, a second micro-switch will be tripped to deactivate the dispenser 52. Of course, the points at which the glue application is started and stopped can be controlled by the proper positioning of the micro-switches, it being important only that substantially the full length of the side wall 41 be provided with one or more lines of glue.

It will be noted that when the fender wrapper 32 initially enters the conveyor section 14, it passes below a depressor member 54. Once the fender wrapper 32 assumes the position indicated by roman numeral II, the upper portion of the flap adjacent the convex section of the fender 38 is engaged by the depressor member 54 to cause the straight edge 42 to contact the floor 46 of the positioner member 44. The depressor member 54 consists of three parallel roller frames 56, 58, and 60 adjustably attached to an L-shaped frame 62 by rods 63, 64, 66, 68, 70, and 72. The L-shaped frame 62 is carried by the base frame 16 for sliding movement between a raised position as seen in FIG. 1 and a lowered position as seen in FIGS. 2 and 4. Movement of the L-shaped frame 62, and accordingly the roller frames 56, 58 and 60, is realized through an air-operated cylinder 74 secured to the base frame. Operation of the cylinder 74 will also be controlled by suitable micro-switches so that the depressor member 54 is placed in the lowered position when the fender wrapper 32 attains the desired position. It will be noted that the roller frames 56, 58, and 60 each support a plurality of rollers 76 which are aligned and uniformly spaced along the length of the associated roller frame.

As mentioned, the depressor member 54 serves to move the straight edge 42 of the flap 40 downwardly into contact with the flat floor 46 of the positioner member 44. The purpose of such movement is to maintain proper orientation of the lower edge of the flap 40 relative to the lower edge of the tubular portion 36 prior to bonding the flap to the side wall 41. It will also be noted that as the fender wrapper 32 enters the conveyor section 14, the movement thereof towards the exit end of the apparatus 10 is automatically provided by an endless belt 78 which extends the full length of the conveyor section 14 and is driven through an appropriate gear box by an electric motor 80. Thus, the belt 78 moves the fender wrapper 32 from the position indicated by the roman numeral II to the position indicated by the roman numeral III. During such time and as mentioned hereinbefore, the glue is applied to substantially the full length of the tubular portion 36 and the lower edge of the flap 40 is guided by the positioner member into engagement with the tubular portion. In this regard, it will be noted that as seen in FIG. 2, a rail 82 is fixed with the base frame 16 and continues the guidance of the flap 40 as the fender wrapper 32 moves from the position indicated by roman numeral II to the position indicated by roman numeral III. The flap 40 is maintained in engagement with the side wall 41 by the rail 82 and then is further pressed towards the tubular portion 36 so as to assure that the glue is cured and proper bonding occurs. In this connection, as the lower part of the flap 40 passes by the rail 82, it is then maintained in engagement with the side wall 41 by a compressor member 84 which includes a plurality of horizontally and vertically aligned rollers 86 which serve to engage the outer surface of the flap 40 as seen in FIG. 5. When the fender wrapper 32 reaches the exit end of the conveyor section 14, the glue is substantially fully cured and the flap 40 securely bonded to the tubular portion 36 so that the fender wrapper 32 is in a condition for shipment. Although not shown, an additional section constructed in the manner of the entrance section 12 can be located in line with the conveyor section 14 and serve as the exit section for the fender wrappers 32 after they leave the conveyor section 14.

Various changes and modifications can be made in this construction without departing from the spirit of the invention. Such changes and modifications are contemplated by the inventor and he does not wish to be limited except by the scope of the appended claims.

I claim:

1. An apparatus for closing an article wrapper having a lower tubular portion integrally formed with an upper flap that terminates with a straight edge, said apparatus including an elongated frame divided into an entrance section and a conveyor section, said entrance section having means for supporting said article wrapper for movement towards said conveyor section while maintaining said flap spaced from said tubular portion, said conveyor section being axially aligned with said entrance section and having a power driven belt for moving said article wrapper along said conveyor section, means carried by said conveyor section for applying adhesive to said tubular portion as said article wrapper moves into said conveyor section, a positioner member located adjacent said conveyor section for receiving the flap of said article wrapper and for guiding the flap into contact with said tubular portion after the adhesive is applied thereto, said positioner member having a flat floor, means for engaging said flap and for maintaining the straight edge thereof in contact with said flat floor prior to the flap contacting said tubular portion, and said conveyor section having means formed therewith for maintaining said flap in contact with said tubular portion to assure that said adhesive is substantially cured so that said flap is bonded to said tubular portion.

2. An apparatus for closing an article wrapper having a lower tubular portion integrally formed with an upper flap that terminates with a straight edge, said apparatus including an elongated frame divided into an entrance section and a conveyor section, said entrance section having roller means for supporting said article wrapper for horizontal movement towards said conveyor section, an elongated rail attached to said entrance section for maintaining said flap spaced from said tubular portion, said conveyor section being horizontally aligned with said entrance section and having a power driven endless belt for moving said article wrapper along said conveyor section, means carried by said conveyor section for applying adhesive to said tubular portion as said article wrapper moves into said conveyor section, a positioner member located adjacent said conveyor section for receiving the flap of said article wrapper and for guiding the flap into contact with said tubular portion after the adhesive is applied thereto, said positioner member having a flat floor, means for depressing the upper portion of said flap so as to maintain the straight edge thereof in contact with said flat floor prior to the flap contacting said tubular portion, and said conveyor section having means formed therewith for pressing said flap into contact with said tubular portion to assure that said adhesive is substantially cured so that said flap is bonded to said tubular portion.

3. An apparatus for closing an article wrapper having a lower tubular portion integrally formed with an upper flap that terminates with a straight edge, said apparatus including an elongated frame divided into an entrance section and a conveyor section, said entrance section having roller means mounted for rotation along inclined axes for supporting said article wrapper for movement towards said conveyor section, an elongated rail coextensive with and attached to said entrance section for maintaining said flap spaced from said tubular portion, said conveyor section being horizontally aligned with said entrance section and having a power driven belt for moving said article wrapper along said conveyor section, means carried by said conveyor section for applying adhesive along the length of said tubular portion as said article wrapper moves into said conveyor section, a positioner member in the form of a trough located adjacent said conveyor section for receiving the flap of said article wrapper and for guiding the flap into contact with said tubular portion after the adhesive is applied thereto, said positioner member having a flat floor, a depressor member above the positioner member for engaging the upper portion of said flap and for moving the latter downwardly so as to maintain the straight edge thereof in contact with said flat floor prior to the flap contacting said tubular portion, and said conveyor section having means formed therewith for pressing said flap into contact with said tubular portion to assure that said adhesive is substantially cured so that said flap is bonded to said tubular portion.

* * * * *